US005572275A

United States Patent [19]

Jinzai

[11] Patent Number: 5,572,275

[45] Date of Patent: Nov. 5, 1996

[54] FIXING DEVICE AND FIXING ROLLER

[75] Inventor: Makoto Jinzai, Yokohama, Japan

[73] Assignee: Canon Kabushiki Kaisha, Tokyo, Japan

[21] Appl. No.: 381,321

[22] Filed: Jan. 31, 1995

Related U.S. Application Data

[63] Continuation of Ser. No. 210,938, Mar. 21, 1994, abandoned.

[30] Foreign Application Priority Data

Mar. 23, 1993 [JP] Japan ..... 5-088209

[51] Int. Cl.[6] ..... G03G 15/20

[52] U.S. Cl. ..... 399/331; 492/53; 492/56

[58] Field of Search ..... 355/285, 289, 355/290; 118/60; 432/60; 219/216; 492/46, 56, 53

[56] References Cited

U.S. PATENT DOCUMENTS

| | | | |
|---|---|---|---|
| 4,375,505 | 3/1983 | Newkirk | 430/99 |
| 4,568,275 | 2/1986 | Sakurai | 432/60 |
| 5,099,560 | 3/1992 | Kato et al. . | |

FOREIGN PATENT DOCUMENTS

| | | |
|---|---|---|
| 106180 | 4/1984 | European Pat. Off. . |
| 186314 | 7/1986 | European Pat. Off. . |
| 2259849 | 8/1975 | France . |
| 50-109280 | 8/1975 | Japan . |
| 53-004035 | 2/1978 | Japan . |
| 57-080040 | 5/1982 | Japan . |
| 58-2864 | 1/1983 | Japan . |
| 56-83878 | 5/1983 | Japan . |
| 59-080457 | 5/1984 | Japan . |
| 59-109546 | 6/1984 | Japan . |
| 62-015212 | 1/1987 | Japan . |
| 3-172311 | 7/1991 | Japan . |
| 3-265768 | 11/1991 | Japan . |

OTHER PUBLICATIONS

Xerox Disclosure Journal, "Viton/RTV Silicone Fuser Release Overcoating", vol. 11, No. 5, p. 207, R. M. Ferguson, et al. (Sep./Oct. 1986).

*Primary Examiner*—R. L. Moses

*Attorney, Agent, or Firm*—Fitzpatrick, Cella, Harper & Scinto

[57] ABSTRACT

A fixing device has a pair of rollers which are pressed against to each other to form a nip therebetween. A recording medium which carries a non-fixed image is clamped and conveyed by the nip to perform fixing. At least one of the pair of rollers has a mixture layer prepared by mixing a perfluoroelastomer having rubber elasticity and a fluorine resin.

22 Claims, 3 Drawing Sheets

FIXING DEVICE AND FIXING ROLLER

This application is a continuation application Ser. No. 08/210,938, filed Mar. 21, 1994,

BACKGROUND OF THE INVENTION

1. Field of the Invention

The present invention relates to a fixing device and a fixing roller for fixing a non-fixed image of an image visualizing agent (toner) on a recording medium, which image is formed and carried on a recording medium such as a transfer medium, a photosensitive paper sheet, an electrostatic recording paper sheet, or the like by a transfer method (indirect method) or a direct method in an image forming means section which adopts an appropriate image formation principle or process such as electrophotography, electrostatic recording, magnetic recording, or the like in an image forming apparatus such as a copying machine, a recording apparatus, a printer, a micro-reader printer, or the like.

2. Related Background Art

As a conventional fixing device for a general image forming apparatus such as an electrophotographic copying machine, devices adopting various fixing methods have been proposed and are practiced. Of these devices, a device of a roller fixing type, in particular a heating roller fixing device (heat roll fixing method) in which at least one of a pair of rollers is a heating roller heated by a heat source is popularly used.

Of the pair of fixing rollers, a roller contacting the image carrier surface of a recording medium will be referred to as a fixing roller or heating roller hereinafter, and the other roller will be referred to as a compression roller hereinafter.

As the fixing roller, the following two rollers are known:

① a so-called "hard roller" prepared by coating a fluorine resin such as a PFA (a copolymer resin of tetrafluoroethylene and perfluoroalkylvinylether), a PTFE (a polytetrafluoroethylene resin), or the like onto the outer surface of a core metal such as aluminum, iron, or the like; and ② a so-called "soft roller" prepared by stacking an elastic rubber layer of, e.g., silicone rubber, fluorine rubber, or the like, on the outer surface of a core metal.

Since the hard roller has high mold release characteristics, it has merits such as high anti-offset characteristics, a high heat resistance, a high durability, and the like.

Since the soft roller has elasticity, it does not excessively press a visualized image (toner image) on a recording medium, and does not blur the image. Therefore, a fixed image has high image quality. Also, since the roller surface finely elastically deforms at the pressing nip portion, the contact area with a toner image on the recording medium can be widened. Therefore, the soft roller has high fixing characteristics.

The compression roller is required to have proper elasticity for attaching a toner image onto the recording medium, and a roller prepared by stacking a layer of silicon rubber or fluorine rubber on the outer surface of a core metal such as aluminum, iron, or the like, a roller prepared by coating the outer surface of the former roller with a PFA tube, or the like is used.

However, as for the fixing roller, the merits of each of the above-mentioned hard and soft rollers are also the demerits of the other.

More specifically, since the hard roller does not have any elasticity, it suffers problems associated with deterioration of image quality caused by excessive pressing of a toner image on a recording medium, and poor fixing characteristics due to a small contact area with the toner image.

Since the soft roller is used in a high temperature range from 180° C. to 200° C., its rubber coating layer is degraded, and the soft roller suffers a problem associated with poor durability.

Also, the compression roller suffers problems associated with a decrease in elasticity, peeling of the PFA tube, and the like caused by thermal degradation of the rubber coating layer.

In order to solve these problems, as a roller material for obtaining a fixing roller which has merits of both the hard and soft rollers, and a compression roller free from the above-mentioned problems, a perfluoroelastomer having rubber elasticity including characteristics such as elasticity, heat resistance, corrosion resistance, high mold release characteristics, and the like, and its improved material (Japanese Laid-Open Patent Application Nos. 50-109280, 59-80457, 59-109546, 62-15212, 3-172311, and the like) have received a lot of attention, and plausibility of their application was examined.

However, when a perfluoroelastomer having rubber elasticity is molded into a fixing roller, or the like, it is difficult to process this material into a complicated shape due to necessity of compression molding in molds, elasticity of the material itself, and the like, as described in Japanese Laid-Open Pat. Application Nos. 57-80040and 3-265768, and the material is not positively utilized in the fixing roller and/or the compression roller of the fixing device.

SUMMARY OF THE INVENTION

It is an object of the present invention to provide a fixing device and a fixing roller, which can provide high image quality and high fixing performance, and have anti-offset characteristics, durability, and heat resistance.

It is another object of the present invention to provide a fixing roller having a mixture layer obtained by mixing a perfluoroelastomer having rubber elasticity and a fluorine resin, and a fixing device comprising the roller.

It is still another object of the present invention to provide a fixing roller having a mixture layer obtained by mixing a perfluoroelastomer having rubber elasticity and a fluorine resin or silicone rubber, and a fixing device comprising the roller.

The above and other objects of the present invention will become apparent from the following description of the preferred embodiments.

DETAILED DESCRIPTION OF THE PREFERRED EMBODIMENTS

The preferred embodiments of the present invention will be described hereinafter with reference to the accompanying drawings.

<First Embodiment>

Figure 1:
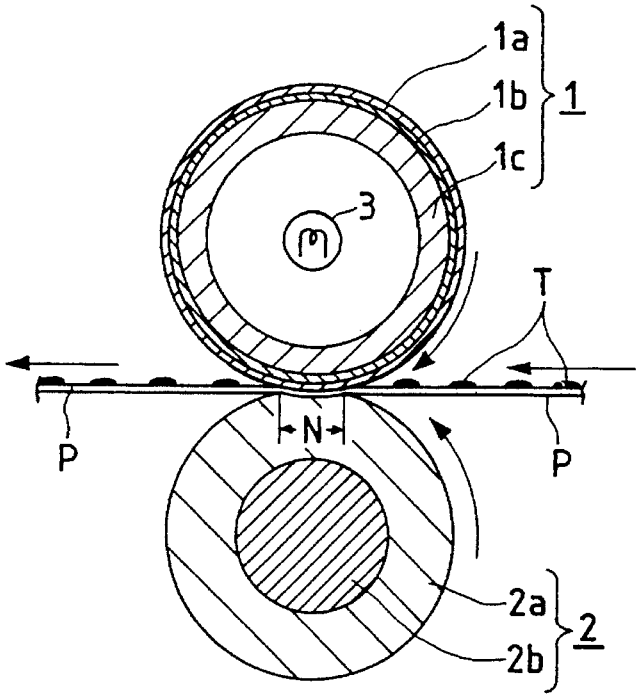
FIG. 1 is a sectional view of a fixing device according to an embodiment of the present invention.

FIG. 1 is a schematic sectional view of a fixing device of this embodiment.

A pair of fixing rollers 1, 2 which are vertically and substantially parallelly pressed against each other at a predetermined pressing force include a fixing roller (heating roller) 1 and a compression roller 2.

A heat source 3 such as a halogen heater is arranged in the fixing roller 1. Energization of the heat source 3 is controlled by a temperature control circuit including a fixing roller temperature sensor (not shown), thereby controlling the surface temperature of the fixing roller 1 to a predetermined temperature.

The fixing roller 1 is prepared as follows. That is, a primer layer 1*b* of, e.g., PAI is coated on the surface of a core metal 1*c* consisting of a metal such as aluminum by a known method, and a material obtained by blending a perfluoroelastomer (available from DU PONT, trade name: Kalrez) having rubber elasticity and a commercially available PFA resin is coated and sintered on the primer layer 1*b* to form an anti-offset layer 1*a*.

The compression roller 2 is prepared by coating a silicone rubber layer 2*a* on a metal core 2*b*.

The pair of rollers 1 and 2 are rotated at a predetermined speed by a driving means (not shown).

A non-fixed toner image T is formed and carried on a recording medium P by an image formation means unit. The recording medium P is fed to a pressing nip portion (nip width of 5 to 6 mm) N between the pair of rollers 1 and 2, and is clamped and conveyed in the pressing nip portion, so that the toner image is fixed by the heat and pressure.

In the fixing roller 1 of this embodiment, more specifically, an aluminum pipe having a diameter of 40 mm was used as the core metal 1*c*, and its outer surface was roughened by honing using a #1000 alumina powder. The primer layer 1*b* was coated on the core metal to have a thickness of about 10 μm , and was dried at 150° C. for 15 minutes. Thereafter, a material obtained by blending a perfluoroelastomer powder having rubber elasticity and a PFA resin by dispersing them into water was coated on the primer layer to have a thickness of about 10 m. The coated layer was sintered at 400° C. for 20 minutes, thus forming the anti-offset layer 1*a*.

More specifically, in this embodiment, the perfluoroelastomer already has rubber elasticity when it is coated on the primer layer, and exhibits strong elasticity after molding.

The physical properties of the perfluoroelastomer used in this embodiment are listed below:

| | |
|---|---|
| 100% modules (kgf/cm$^2$) *1 | 172.3 |
| psi | 2450 |
| tensile strength upon breaking (kgf/cm$^2$) *1 | 221.5 |
| psi | 3150 |
| extension upon breaking % *1 | 125 |
| hardness, durometer A ± 5 | 90 |
| compression permanent strain % *2 | |
| 70 hours at normal temperature | 30 |
| 70 hours at 204° C. | 35 |
| brittle point °C. | −37 |

*1 ASTM D412, 500 mm/min (20 in/min)
*2 ASTM D395B pellets

A perfluoroelastomer suitably used in this embodiment is disclosed in Japanese Laid-Open Patent Application No. 59-80457, Japanese Patent Publication No. 53-4035, Japanese Laid-Open Patent Application No. 3-172311, and the like.

More specifically, a perfluoroelastomer manufactured from tetrafluoroethylene, perfluoroalkylvinylether, and a polymer unit of a nitrile-containing monomer is preferable.

As described above, according to this embodiment, since the perfluoroelastomer is blended with a fluorine resin, a difficult process using only the perfluoroelastomer can be avoided, and the merits of the perfluoroelastomer can be obtained by an easy method.

Since the fixing roller 1 has high elasticity, deterioration of image quality and poor fixing characteristics due to poor elasticity as the drawbacks of the conventional hard roller can be remarkably eliminated, and performance as high as that of the soft roller can be provided.

Furthermore, a fixing device which has excellent anti-offset characteristics, durability, and heat resistance, and can provide totally very high performance, can be realized.

<Second Embodiment>

Figure 2:
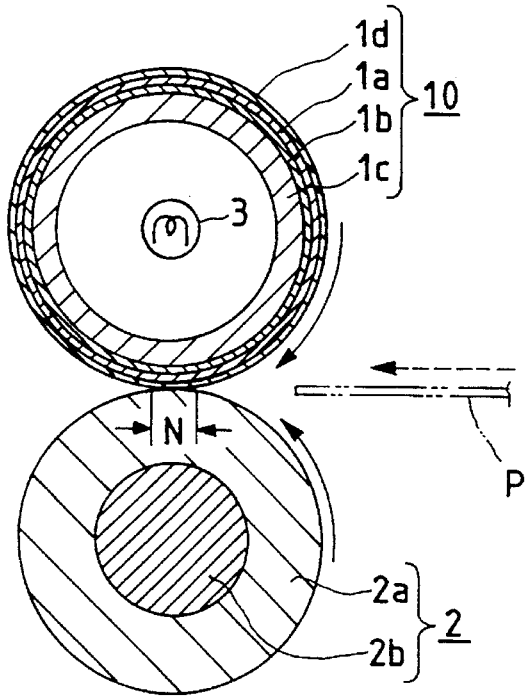
FIG. 2 is a sectional view of a fixing device according to another embodiment of the present invention.

Another embodiment of the present invention will be described below-with reference to FIG. 2.

This embodiment is characterized by using a fixing roller 10 prepared by further forming a coating (anti-offset layer) 1*d* consisting of only a fluorine resin such as a PFA, PTFE, or the like on a coating layer 1*a* of the fixing roller 1 of the first embodiment.

More specifically, in the fixing roller 10 of this embodiment, an aluminum pipe having a diameter of 40 mm was used as a core metal 1*c*, and its outer surface was roughened by honing using a #1000 alumina powder. A primer layer 1*b* was coated on the core metal to have a thickness of about 10 μm, and was dried at 150° C. for 15 minutes. Thereafter, a material obtained by blending a perfluoroelastomer having rubber elasticity and a PFA resin by dispersing them into water was coated on the primer layer to form a coating layer 1*a* having a thickness of about 10 μm. The coating layer was dried at 150° C. for 15 minutes. Finally, a PFA resin was solely coated to have a thickness of 2 to 3 μm. The coated layer was sintered at 400° C. for 20 minutes, thus forming an anti-offset layer 1*d*.

Since this fixing roller 10 has high elasticity and very high mold release characteristics, a fixing device which can provide high image quality and excellent fixing performance, and also has excellent anti-offset characteristics, durability, and heat resistance, can be realized.

<Third Embodiment>

Figure 3:
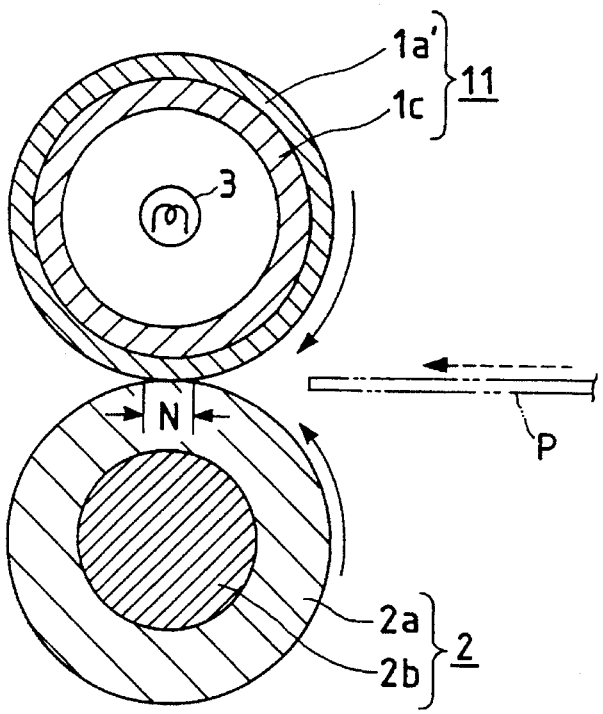
FIG. 3 is a sectional view of a fixing device according to still another embodiment of the present invention.

Still another embodiment of the present invention will be described below with reference to FIG. 3.

In this embodiment, an anti-offset layer 1*a*' of a fixing roller 11 is formed by a mixture of a perfluoroelastomer having rubber elasticity and fluorine rubber or silicone rubber.

More specifically, in the fixing roller 11 of this embodiment, an aluminum pipe having a diameter of 40 mm was used as a core metal 1*c*, and a mixture of a perfluoroelastomer having rubber elasticity and fluorine rubber or silicone rubber was stacked on the core metal. The stacked mixture layer was vulcanized to form the anti-offset layer 1*a*'.

The heat resistance and anti-offset characteristics of this fixing roller 11 are remarkably improved as compared to those of the conventional soft fixing roller, and a totally excellent fixing device which can provide high image quality and excellent fixing performance can be realized.

<Fourth Embodiment>

Figure 4:
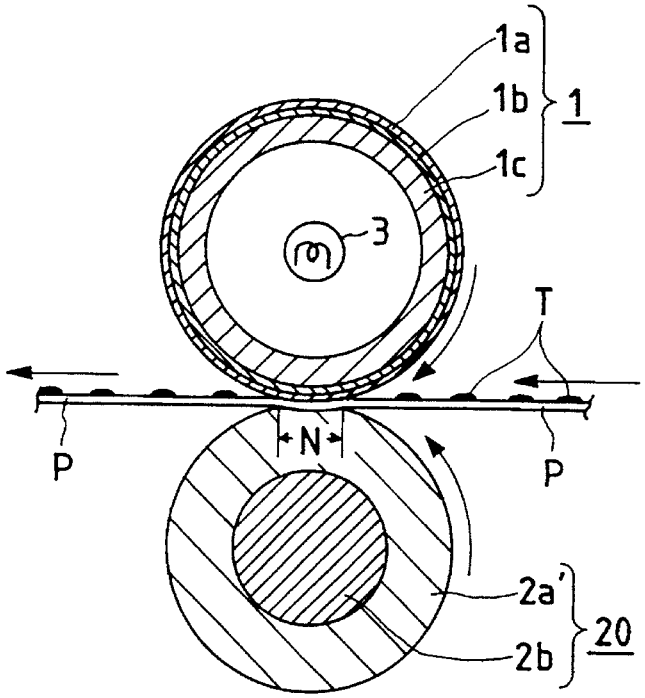
FIG. 4 is a sectional view of a fixing device according to still another embodiment of the present invention.

Still another embodiment of the present invention will be described below with reference to FIG. 4.

This embodiment is characterized by using a mixture of silicone rubber or fluorine rubber and a perfluoroelastomer having rubber elasticity as an elastic layer 2*a*' constituting a compression roller 20 in the first embodiment.

More specifically, the compression roller 20 is formed as follows. That is, a perfluoroelastomer having rubber elasticity is mixed in silicon rubber, and a 5-mm thick elastic layer 2*a*' consisting of the mixture is stacked and vulcanized on the surface of a core metal 2*b* of, e.g., SUS having a diameter of 30 mm.

In this compression roller 20, the physical properties of silicone rubber were improved as the effect of the perfluoroelastomer having rubber elasticity. Therefore, the compression roller 20 had very high heat resistance and mold release characteristics, and also had very high anti-offset characteristics without using a PFA tube unlike in the conventional compression roller.

More specifically, upon combination of the compression roller 20 of this embodiment and the fixing roller 1, 10, or 11 of one of the first to third embodiments, a totally excellent fixing device which can provide high image quality and high fixing performance, and has high anti-offset characteristics and durability can be realized.

Note that the arrangement of the compression roller of this embodiment can be applied to those of the second and third embodiments described above, as a matter of course.

<Fifth Embodiment>

Figure 5:
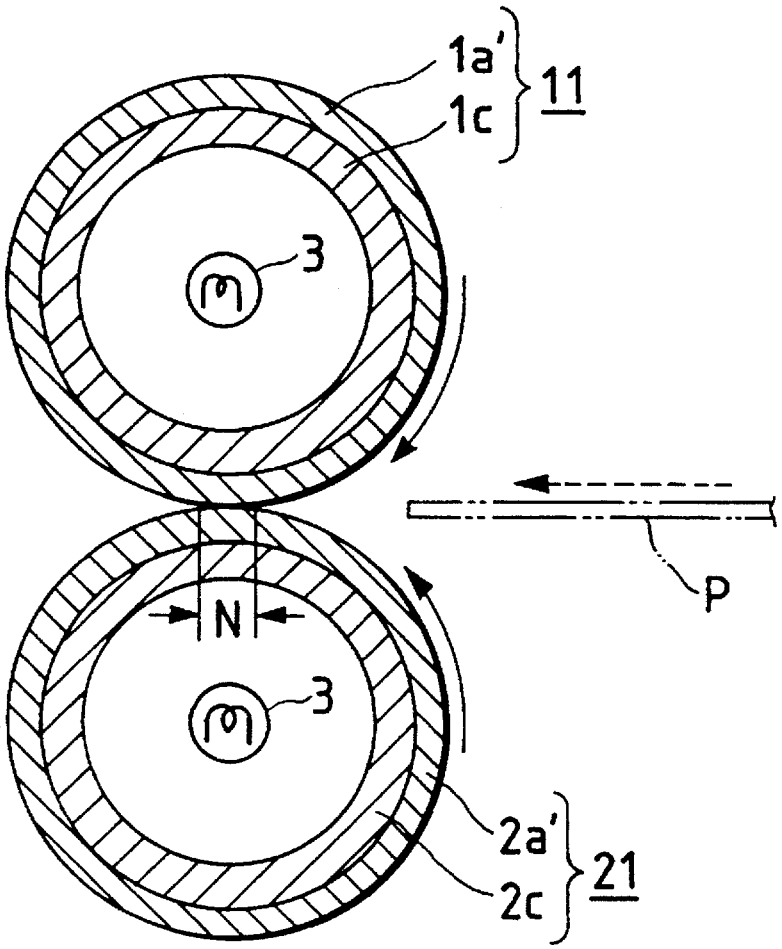
FIG. 5 is a sectional view of a fixing device according to still another embodiment of the present invention.

Still another embodiment of the present invention will be described below with reference to FIG. 5.

This embodiment mainly relates to the arrangement of a fixing device suitable for fixing processing of a full-color image.

In general, since a full-color image obtains desired colors by completely melting and mixing a plurality of color image visualizing agents (color 10 toners), the toners must be melted and be completely mixed to develop colors in fixing processing. For this reason, the fixing roller and the compression roller are strongly required to have elasticity in addition to the heating function.

Furthermore, for the above-mentioned reason, since the toners are completely melted, an offset phenomenon, i.e., transfer of the toners onto the surface of the fixing roller, easily occurs. Therefore, the roller surface is required to have high mold release characteristics, at the same time.

In order to solve these problems, in this embodiment, when surface layers 1*a*' and 2*a*' of a fixing roller 11 and a compression roller 21 comprise a layer of a mixture of silicone rubber or fluorine rubber and a perfluoroelastomer having rubber elasticity, the fixing roller 11 and the compression roller 21 having very high elasticity and mold release characteristics can be formed and used.

Note that the compression roller 21 has a core metal 2*c*.

In this embodiment, both the fixing roller 11 and the compression roller 21 are heat rollers each of which incorporates a heat source 3.

Upon combination of the fixing roller 11 and the compression roller 21 according to this embodiment, a fixing device, which can provide high image quality and high fixing performance, has high anti-offset characteristics, high durability, and high heat resistance, and is suitable for fixing of a full-color image, can be realized.

The present invention has been described with reference to its embodiments. However, the present invention is not limited to the above embodiments, and various modifications may be made within the technical scope of the present invention.

What is claimed is:

1. A fixing device comprising:

a pair of rollers respectively pressed against to each other to form a nip therebetween, wherein a recording medium which carries a non-fixed image is pinched and conveyed by said nip to perform fixing, and at least one of said pair of rollers comprises a mixture layer prepared by mixing a perfluoroelastomer having rubber elasticity and a PFA resin.

2. A device according to claim 1, wherein said mixture layer is formed by coating and sintering a mixture of a perfluoroelastomer having rubber elasticity and a PFA resin.

3. A device according to claim 1, wherein said mixture layer is formed on a core member of the roller.

4. A device according to claim 1, wherein said mixture layer is a surface layer.

5. A device according to claim 1, wherein a resin layer is provided on said mixture layer.

6. A device according to claim 1, wherein at least one of said pair of rollers comprises a heat source.

7. A device according to claim 1, wherein one of said pair of rollers is a fixing roller, and the other one of said pair of rollers is a compression roller.

8. A fixing roller comprising:

a core member; and a mixture layer formed outside said core member, and prepared by mixing a perfluoroelastomer having rubber elasticity and a PFA resin.

9. A roller according to claim 8, wherein said mixture layer is formed by coating and sintering a mixture of a perfluoroelastomer having rubber elasticity and a PFA resin.

10. A roller according to claim 8, wherein said mixture layer is formed on a core member of the roller.

11. A roller according to claim 8, wherein said mixture layer is a surface layer.

12. A roller according to claim 8, wherein a resin layer is provided on said mixture layer.

13. A fixing-device comprising:

a pair of rollers which are pressed against to each other to form a nip therebetween, wherein a recording medium which carries a non-fixed image is pinched and conveyed by said nip to perform fixing, and at least one of said pair of rollers comprises a mixture layer prepared by mixing a perfluoroelastomer having rubber elasticity and a and silicone fluorine rubber.

14. A device according to claim 13, wherein said mixture layer is formed on a core member of the roller.

15. A device according to claim 13, wherein said mixture layer is a surface layer.

16. A device according to claim 13, wherein said mixture layer is formed by coating and sintering a mixture of a perfluoroelastomer having rubber elasticity and a fluorine rubber.

17. A device according to claim 13, wherein at least one of said pair of rollers comprises a heat source.

18. A device according to claim 13, wherein one of said pair of rollers is a fixing roller, and the other one of said pair of rollers is a compression roller.

19. A fixing roller comprising:

a core member; and a mixture layer formed outside said core member, and prepared by mixing a perfluoroelastomer having rubber elasticity and a fluorine rubber.

20. A roller according to claim 19, wherein said mixture layer is formed on a core member of the roller.

21. A roller according to claim 19, wherein said mixture layer is a surface layer.

22. A roller according to claim 19, wherein said mixture layer is formed by coating and sintering a mixture of a perfluoroelastomer having rubber elasticity and a fluorine rubber.

* * * * *

UNITED STATES PATENT AND TRADEMARK OFFICE

CERTIFICATE OF CORRECTION

PATENT NO. : 5,572,275
DATED : November 5, 1996
INVENTOR(S) : JINZAI

It is certified that error appears in the above-indentified patent and that said Letters Patent is hereby corrected as shown below:

COLUMN 4

Line 16, change "below-with" to --below with--.

COLUMN 5

Line 28, delete "10";
Line 60, delete "respectively" and "to".

COLUMN 6

Line 29, change "fixing-device" to "fixing device";
Line 37, delete "and silicone".

Signed and Sealed this

Eleventh Day of March, 1997

*Attest:*

*Attesting Officer*

Bruce Lehman

BRUCE LEHMAN

*Commissioner of Patents and Trademarks*